United States Patent [19]

Yamazaki et al.

[11] Patent Number: 4,752,963

[45] Date of Patent: Jun. 21, 1988

[54] ELECTROACOUSTIC CONVERTER HAVING A RECESSED STEP ON THE CENTER POLE

[75] Inventors: Kaoru Yamazaki, Akikawa; Shiro Iwakura, Tokyo; Masatoshi Kunii, Iruma; Toshihiro Hayashi, Kunitachi; Yoshio Sakamoto, Hachioji, all of Japan

[73] Assignee: Kabushiki Kaisha Kenwood, Japan

[21] Appl. No.: 871,836

[22] Filed: Jun. 9, 1986

[30] Foreign Application Priority Data

| | | | |
|---|---|---|---|
| Jun. 12, 1985 | [JP] | Japan | 60-88660[U] |
| Jun. 12, 1985 | [JP] | Japan | 60-88661[U] |
| Jun. 12, 1985 | [JP] | Japan | 60-88662[U] |
| Jun. 12, 1985 | [JP] | Japan | 60-88657[U] |
| Jun. 12, 1985 | [JP] | Japan | 60-88659[U] |

[51] Int. Cl.[4] ..... H04R 7/18; H04R 7/20

[52] U.S. Cl. ..... 381/193; 381/194; 381/199; 381/201

[58] Field of Search ..... 381/193, 192, 194, 195, 381/197, 199, 201

[56] References Cited

U.S. PATENT DOCUMENTS

| | | | |
|---|---|---|---|
| Re. 26,030 | 5/1966 | Marchand et al. | 381/197 |
| 2,392,143 | 1/1946 | Graham | 381/194 |
| 2,395,166 | 2/1946 | Collins | 381/194 |
| 2,551,949 | 5/1951 | Hunter | 381/197 |
| 2,604,551 | 7/1952 | Charlesworth | 381/197 |
| 2,942,071 | 6/1960 | Witchey | 381/197 |
| 3,766,334 | 10/1973 | Burke | 381/195 |
| 3,790,724 | 2/1974 | Schenkel | 381/194 |
| 3,867,586 | 2/1975 | Maekawa et al. | 381/192 |
| 3,991,286 | 11/1976 | Henricksen | 381/194 |
| 4,317,965 | 3/1982 | Toyoda | 381/194 |

*Primary Examiner*—Jin F. Ng
*Assistant Examiner*—Danita R. Byrd
*Attorney, Agent, or Firm*—Gerald J. Ferguson, Jr.

[57] ABSTRACT

In an electroacoustic converter, center pole and top plate which constitute a magnetic circuit are mechanically abutted against each other by interposing an air gap defining member therebetween. The air gap defining member is a projection provided on the center pole or top plate, otherwise non-magnetic ring-like sleeve covered on the center pole or top plate. An air gap in the magnetic circuit can be precisely defined by the air gap defining member without using any alignment tool in its assemble process.

16 Claims, 5 Drawing Sheets

PRIOR ART FIG. 2C

ELECTROACOUSTIC CONVERTER HAVING A RECESSED STEP ON THE CENTER POLE

BACKGROUND OF THE INVENTION

1. Field of the Invention

The present invention relates to an electroacoustic converter, and more particularly is directed to an improvement on an electroacoustic converter such as a loudspeaker or a microphone having a dome-like diaphragm.

2. Related Background Art

A conventional dome-like loudspeaker has a cross-section as shown in FIG. 1. The magnetic circuit is constructed of a center pole 38, a yoke 39, a magnet 301, and a top plate 34. A magnetic gap is formed between the outer wall of the center pole 38 and the inner wall of the top plate 34. A known diaphragm system is constructed of a unit body of a dome-like diaphragm 30 and a coil bobbin section 35 integrally formed with the diaphragm 30 and having a voice coil wound thereabout, and a curved edge section 31 attached to the unit body. Another is constructed of a unit body of a dome-like diaphragm 30 and an edge section 31, and a coil bobbin attached to the unit body. In such diaphragm system, the coil bobbin section 35 together with the voice coil 36 is properly inserted in the magnetic gap, and the outer periphery of the edge section 31 is sandwiched, at a supporting step formed at the inner wall of the top plate 34, between edge supporting members 33 having almost no resilience. The diaphragm system is fixedly supported by pressing the edge pressing members 33 by the tip of a frame 302. Conventionally, a jig 304 shown in FIG. 2A has been used to precisely define a magnetic gap during an assembly process of a loudspeaker. The jig is formed with a tubular section 305 whose thickness corresponds the magnetic gap, and the top plate 34 is assembled by covering the tubular section 305 on the center pole 38. The magnetic circuit elements 34, 301, and 39 are coupled together with adhesive agent, and after drying and hardening of the adhesive agent, the jig 304 is removed to complete the magnetic circuit as shown in FIG. 2B.

Conventional magnetic circuits described above have required a jig for formation of an adequate magnetic gap. In addition, to remove the jig after hardening of the adhesive agent, it is necessary to provide some clearances g between the center pole 38 and the tubular section 305 and between the tubular section 305 and the top plate 34, as particularly shown in the enlarged cross section of FIG. 2C. As a result, there are associated with some problems that it is difficult to obtain a uniform gap, and that the clearance g must necessarily be incorporated to define the gap distance. This clearance g degrades particularly the performance of a high frequency loudspeaker. Further, use of an adhesive agent for bonding each magnetic circuit element requires a time for drying and hardening, thereby resulting in a loss in time during an assembly process.

A dome-like loudspeaker is constructed in such a way that the outer periphery or brim 32 of the edge section 31 extended from the diaphragm 30 is sandwiched between the ring-like edge supporting members 33 which are bonded to the top plate 34 for support of the diaphragm system. With such construction, the lead wires 37 of the coil 36 wound about the coil bobbin section 35 are drawn to the side of the edge section 31 and sandwiched between the edge supporting members 33. Generally, a middle- and high-frequency dome-like loudspeaker of this type is small in dimension and has a narrow edge section. Therefore, the lead wires 37 are carefully guided so as not to contact the edge section 31 or the top plate 34, and carefully sandwiched so as not to cut or make short-circuited. Such wiring operation of the lead lines 37 is very difficult and complicated at a limited working space, thus causing a low productivity and a low yield.

Also, the diaphragm system with a conventional supporting structure moves using the inner wall corners of the edge supporting members as a fixed point. Therefore, a substantial stress may be applied to the edge section, and a deteriorated sound quality may occur due to such a large distortion at about fo.

SUMMARY OF THE INVENTION

The electroacoustic converter of the invention seeks to solve the about problems.

According to the structure of the invention, at least one of the center pole and the top plate is provided with an incised step which defines a magnetic gap when the center pole and the top plate are abutted against each other for engagement therebetween. Otherwise, a non-magnetic ring is covered on the center pole to define a magnetic gap by the thickness of the ring when the center pole and the top plate are abutted against each other with the ring interposed therebetween.

According to another aspect of the structure of the invention, the diaphragm system comprises a unit body of a dome-like diaphragm, a cylindrical coil bobbin section formed at the lower portion of the diaphragm, and a brim-like edge generally orthogonal to the coil bobbin, and has a derby hat shape as a whole. Incised steps are formed at the engagement portion of the center pole with the top plate to accordingly form an L-shaped channel between the center pole and the top plate. The vertical leg portion of the L-shaped channel forms a magnetic gap and the coil bobbin section is positioned thereat. At the horizontal leg portion, the brim-like edge is positioned which is fixed by pressure from the center pole and the top plate via packing members. Compliance of the diaphragm is determined depending upon the resilience and shape of the packing members. Two signal lead lines of the voice coil wound about the coil bobbin section are both taken from the lower portion of the coil bobbin section and drawn along the brim-like edge. Therefore, the two lead lines together with the brim-like edge are fixed by pressure between the packing members. A guide channel is formed on the top plate to guide the lead lines and connect them to the signal terminals.

Other aspects of the construction of the present invention will become apparent from the following detailed description when read in connection with the accompanying drawings.

BRIEF DESCRIPTION OF THE DRAWINGS

FIGS. 2A to 2C illustrate the assembly process of the magnetic circuit of the conventional loudspeaker of FIG. 1;

DETAILED DESCRIPTION OF THE EMBODIMENTS

Figure 1:
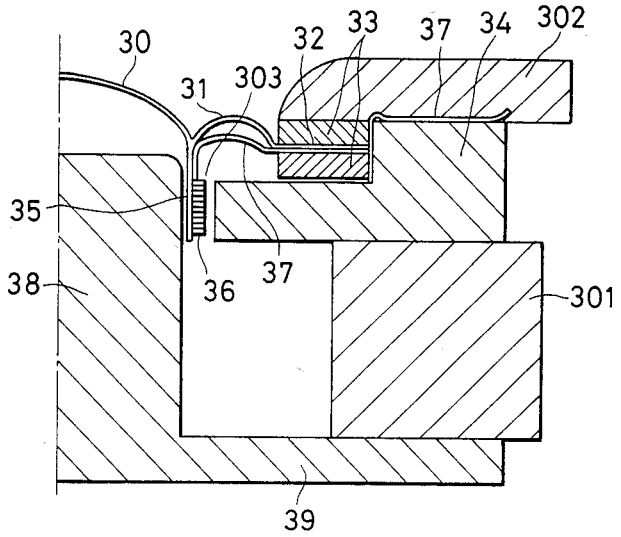
FIG. 1 PRIOR ART
FIG. 1 is a cross section showing the structure of a conventional dome-like loundspeaker.
Figure 2A:
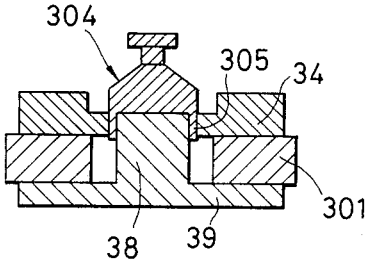
FIG. 2A PRIOR ART
Figure 2B:
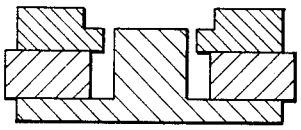
FIG. 2B PRIOR ART
Figure 2B:
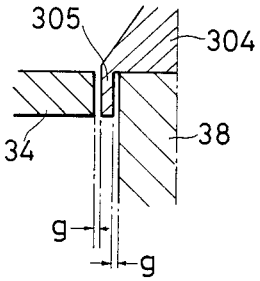
FIG. 2B PRIOR ART
Figure 3:
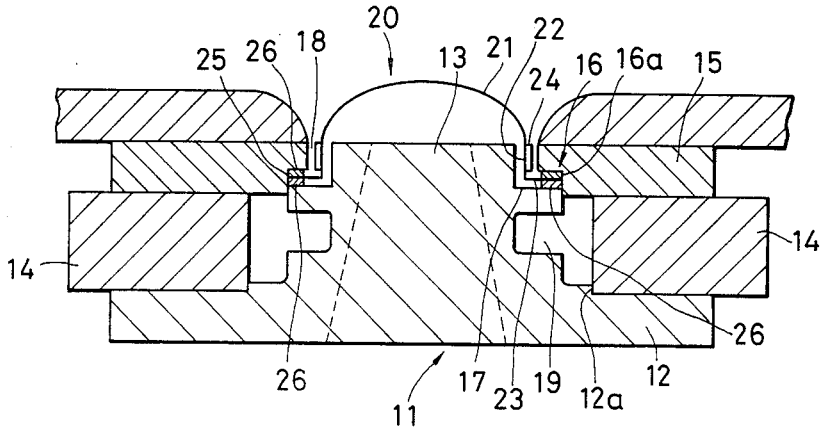
FIG. 3 is a cross section showing the structure of a dome-like loudspeaker according to an embodiment of the present invention.

FIG. 3 shows the main part of the structure of the dome-like loudspeaker according to an embodiment of the present invention. In the figure, there is provided a unit body constructed of a dome-like diaphragm 21, a coil bobbin section 22, and an edge section 23 formed at the lowermost portion of the coil bobbin section and extended horizontally. The center pole 13 is chipped off at its shoulder to form a step and the top plate 15 is also chipped off at its shoulder to form a step. The center pole 13 and top plate 15 are mechanically engaged with each other at their corners. A guide section 16 or a step 16*a* for alignment of the edge section 23 is formed on a top plate 15 at the lower inner periphery at the side facing a magnet 14. The outer end 25 of the edge section 23 is abutted against the wall of the step 16*a*, and the edge section 23 is further interposed between edge supporting members 26 made of resilient material, for engagement of the edge section 23 with the top plate 15. The lower inner periphery of the step 16*a* is made tightly engaged with an engagement section 17 formed at the shoulder of the center pole 13. As a result, assembly of the magnetic circuit 11 including a yoke 12 as well as alignment of the diaphragm system 20 to a predetermined position, is simultaneously performed. Thus, a magnetic gap 18 together with a coil 24 is precisely disposed without using a position alignment jig. The magnetic gap 18 is also referred to herein as an air gap 18. In the figure, reference number 19 represents a recess formed underneath the engagement section 17 so that the engagement section 17 is made of a flange shape to have a large magnetic reluctance.

The dome-like loudspeaker may be of a closed type at the back of the diaphragm, or may be provided with a horn cavity indicated by dotted lines in FIG. 3 in the center pole for incorporation of a back pressure.

Figure 4:
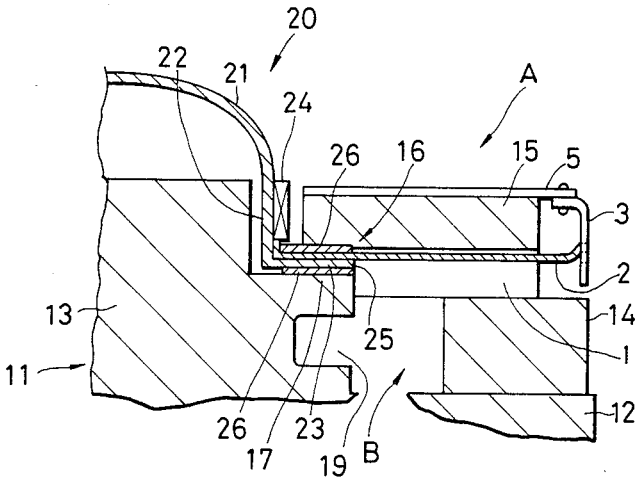
FIG. 4 is an enlarged cross section of the structure of the loudspeaker of FIG. 3.

FIG. 4 shows a more detailed construction of the embodiment of FIG. 3, wherein a guide structure for the lead lines of the voice coil is shown in detail.

The coil 24 are wound about the coil bobbin section 22 in such a way that the start and end of the coil 24 are drawn from the lowest portion of the bobbin section 22. For instance, a lap winding of the coil 24 may be employed wherein the coil 24 is wound first from the lowest portion of the bobbin section, and after wound up to the highest portion, the coil is wound toward the lowest portion. Reference numeral 1 represents a channel formed on the lower surface of the top plate 15. In the embodiment, the channel is formed of a V-shape in section and is provided symmetrically of the plate to guide two lead lines 2 independently. The shape of the channel 1 is not limited thereto, but any shape may be applied if it has a cross-sectional area sufficient for accommodating the lead line 2. Also, two channels 2 are not necessarily required and two lead lines may be guided in a single channel 2 if high insulation lead lines are used.

Although the lead lines 2 may use the coil wire itself, net wire lines connected to the coil wire may be used as the lead line 2 for increasing the strength of the lines. The ends of the lead lines are connected to a terminal plate 3 provided on an insulation board 5.

The lead lines 2 are drawn to the outside, with both lines being sandwiched between the edge section 23 and the edge supporting members 26. In this case, since the depth of the channel is formed such that the positions where the lead lines are taken from the bobbin section are even with or below the bottom of the channel, harmful bending stress is not applied to the lead lines 2. The edge supporting members 26 serving as packing members are made of flexible material such as urethane, soft rubber or the like.

Figure 5:
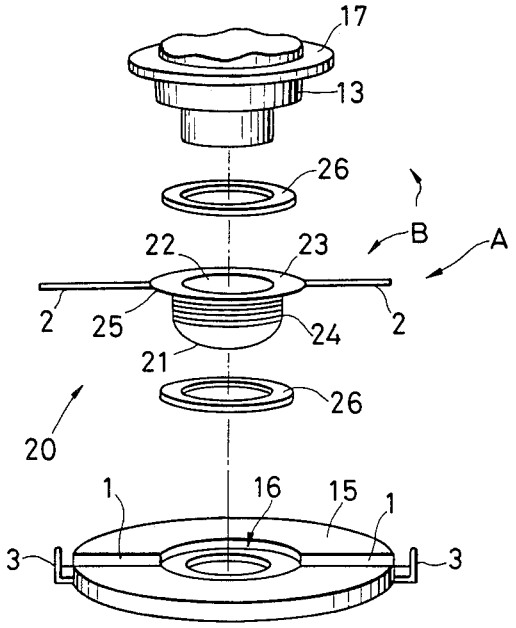
FIG. 5 is an exploded view for explaining the assembly process of the dome-like loudspeaker of FIG. 3.
Figure 6:
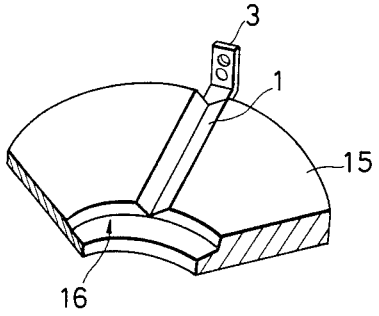
FIG. 6 shows a lead line guide channel formed in the top plate.

An assembly process will be explained with reference to FIG. 5. First, the edge supporting member 26, the diaphragm system 20, and the other edge supporting member 26 are superposed in this order within the step 16*a* of the top plate 15. Thereafter, the center pole 13 is pressed in the top plate 15 in such a way that the outer periphery of the engagement section 17 engages with the guide section or step 16*a* of the top plate 15. In this case, the lead lines 2 are disposed in the channel 1.

With this process, the lead lines 2 can be extended along the edge section 23 to the outside of the magnetic circuit unit B through the channel 1 formed on the lower surface of the top plate 15. Thus, it is very easy to extend the lead lines to the outside as compared with a conventional process having a possibility of breakage of lead lines. Further, any work for giving flexibility to the lead wires as in the conventional process is not needed, thus resulting in a simplification of assembly and a substantial improvement on working efficiency. The lead lines are sandwiched between the edge section 23 and the upper edge supporting member 26, so that there is no possibility of resonance caused by the vibration of the diaphragm system 20. As shown in FIG. 4, by extending the inner end of the edge supporting members 26 up to the outer periphery of the coil bobbin section 22, it is possible to fixedly abut the lead lines 2 to the coil bobbin section 22, thus avoiding such as undesirable resonances more reliably.

Figure 7:
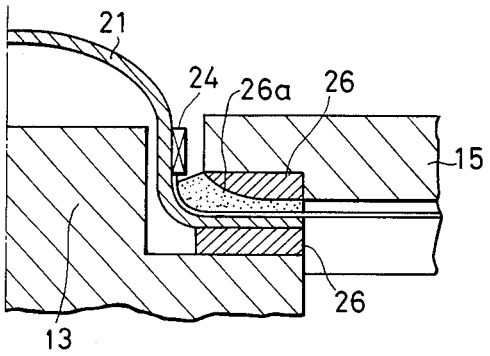
FIG. 7 shows a structure wherein a brim-like edge of the diaphragm system is fixed by an additional packing member.

In the embodiment shown in FIG. 4, the shape of the coil bobbin section 22 and the edge portion 23 is rectangular in section, so that the tight coupling between the packing and edge supporting members 26 and the coil bobbin section 22 can be assured by forming the inner walls of the edge supporting members 26 in a rectangular shape. FIG. 7, shows an example of the above-described tight coupling in the form of a curved surface, wherein a packing member 26*a* for purpose of pressing only is interposed between the edge section 23 and the packing member 26 at the top plate side 15 thereby allowing a tight coupling relative to the curved surface.

As seen from the above, the coil on the coil bobbin section is wound so as to locate its start and end at the lower portion of the coil, and the lead lines of the coil are drawn out along the edge section to the channel formed in the lower surface of the top plate. Accordingly, the work necessary for coil end disposal becomes very easy and the productivity is remarkedly improved. Particularly, flexibility in lead lines as in the conventional process is not needed for drawing the lines to the outside of the magnetic circuit unit, and in addition the wiring of the lead lines is finished simultaneously with the assembly of the top plate, thus enabling an easy wiring and avoiding breakage or short-circuit of the lead lines to attain an excellent reliability.

Figure 8A:
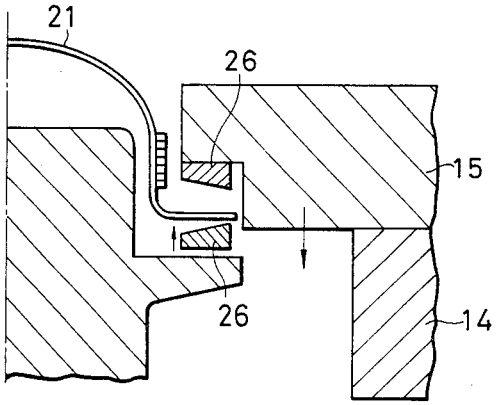
FIGS. 8A and 8B show the structures of tapered packing members.
Figure 8B:
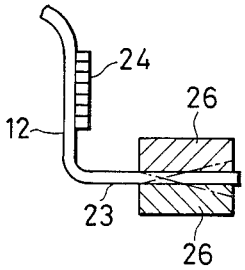

By determining the thickness of the packing and supporting members so that they are not subjected to compression when the top plate 15 is assembled, the edge portion 23 can be sandwiched in a natural state. Conversely, a predetermined biased-pressure may be applied, for the purpose of obtaining a linearity of the diaphragm, to the edge section by using a thicker packing members for sandwiching the edge section. Use of packing members having cross sections different from the above embodiment, is shown in FIG. 8A. Such packing members are symmetrically disposed as shown in FIG. 8B to sandwich the edge section in a compressed state to make the biased pressure greater toward the outside in the radial direction of the edge section. Thus, the frequency characteristic of the diaphragm may be varied. The cross section of the packing member 26 for use with such purpose may obviously take various shapes.

In the embodiment shown in FIG. 3, an engagement of the engagement section 17 of the center pole 13 with the guide section 16 of the top plate 15 is provided to form a magnetic gap and press the edge supporting members of the diaphragm system 20. Thus, the center pole 13 and the top plate 15 mechanically contact each other. To obtain sufficient magnetic flux passing through the magnetic gap, a high magnetic reluctance of the mechanical contact portion is required. To this end, the recess 19 has been formed in the center pole 13. Modified structures shown in FIGS. 9A and 9B may also be applied.

Figure 9A:
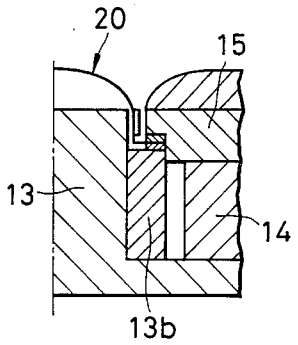
FIGS. 9A to 9B show structures respectively defining the magnetic gap by a non-magnetic ring.
Figure 9B:
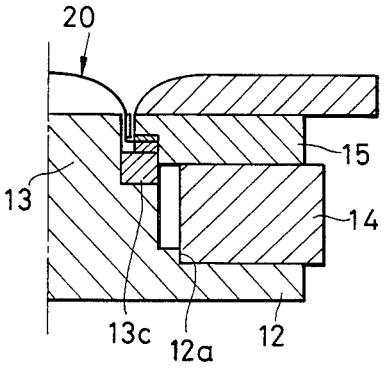
Figure 10:
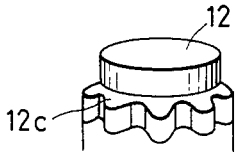
FIG. 10 shows a structure defining the magnetic gap by a corrugated protrusion.

In the example shown in FIG. 9A, a pipe 13*b* having a predetermined height and made of non-magnetic material is fittingly pressed about the outer periphery of the center pole 13. In the example of FIG. 9B, a ring 13*c* made of non-magnetic material is fittingly pressed about the outer periphery of the center pole 13. The upper and outer periphery portion of the pipe or ring serves as the engagement section with the top plate 15. The engagement section may be provided locally (at least two positions) at symmetrical positions about the periphery of the center pole for locally fixing the top plate 15, e.g., as shown in FIG. 10 a corrugated protrusion is provided. Reference 12*a* represents a position alignment step formed on the upper surface of the yoke 12. Provision of the step 12*a* allows a precise center of the magnet 14 by positioning the inner periphery of the magnet to the step 12*a*.

In assembling this structure, the edge section of the diaphragm system 20 is fitted above the edge supporting member and engaged with the step of the top plate 15, and further sandwiched with the other edge supporting member. During engagement operation of the edge section to the step of the top plate 15, the outer periphery of the edge section is guided to the innermost wall of the step so that the center of the diaphragm is automatically aligned. Next, after placing the magnet 14 on the yoke 12, the top plate 15 is pressed in by positioning the lower inner periphery at the engagement section of the center pole 13. As a result, the magnet 14 is fixedly sandwiched between the yoke 12 and the top plate 15, and the lower inner periphery of the top plate 15 is tightly abutted against the engagement section of the center pole 13. Thus, a predetermined magnetic gap can be formed without using a jig as conventional, and the voice coil is automatically disposed at the predetermined position within the magnetic gap. After magnetizing the magnet 14 assembled as above, the yoke 12 and the top plate 15 are attracted thereto to mount the magnet more fixedly.

Figure 11:
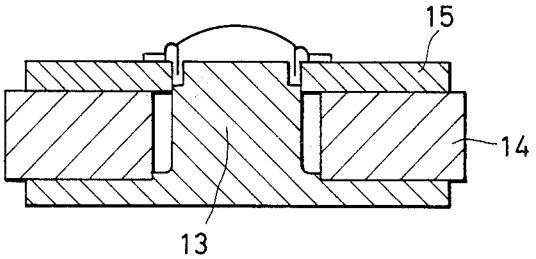
FIG. 11 shows a structure of an incised step formed on the center pole for defining the magnetic gap of a conventional dome-like diaphragm system.

A precise definition of the magnetic gap of the magnetic circuit can be made without using the jig, by covering the top plate 15 through its central hole on the shoulder of the center pole 13 and forming the magnetic gap between the inner wall of the central hole and the outer wall of the step at the shoulder of the center pole 13. This structure, shown in FIG. 11, is applicable to loudspeakers of a conventional diaphragm type. Although leakage flux is small due to the contact width of about 0.5 mm between the center pole 15 and the top plate 13, it can readily be understood that a recess or the structure shown in FIGS. 9A, 9B, or 10 may be applied to the structure of FIG. 11 to further reduce leakage flux.

What is claimed is:

1. An electroacoustic converter comprising:

a diaphragm system including a diaphragm, a coil bobbin and a voice coil wound around the coil bobbin; and a magnetic circuit including a center pole, a yoke, a magnet, a top plate and an air gap where the voice coil is positioned, wherein the center pole has a shoulder having a recessed step therein, the top plate having a step with a vertical wall, and the center pole and top plate being directly abutted against each other at their corners so that the air gap is formed at the recessed step between the center pole and the top plate and the peripheral edge of said diaphragm system is mechanically defined by the vertical wall of the step of the top plate.

2. An electroacoustic converter according to claim 1, wherein said center pole has a shoulder having a recessed step, and being partly incised under the recessed step to increase the magnetic resistance at abutting corners of said center pole and said top plate.

3. An electroacoustic converter comprising:

a diaphragm system including a dome-like diaphragm, a coil bobbin attached to a lower verge of the dome-like edge, and a brim-like edge attached to a lower verge of the coil bobbin;

a magnetic circuit including a center pole having a sidewall, a yoke, a magnet, a top plate and an air gap; and a non-magnetic ring sleeve applied onto part of the sidewall of the center pole so that a step is formed by a sidewall of the center pole and a top portion of the ring sleeve, said top plate having a shoulder with a recessed step therein, and the ring sleeve and the top plate being mechanically abutted against each other such that the steps thereof face with each other to form an L-shaped space channel, and the voice coil being positioned within a vertical leg of the L-shaped space channel, and the brim-like edge of the diaphragm system being fixed to the magnetic circuit within a horizontal leg of the L-shaped space channel.

4. An electroacoustic converter comprising:

a diaphragm system including a dome-like diaphragm, a coil bobbin attached to a lower verge of the dome-like diaphragm, a voice coil wound around the coil bobbin and a brim-like edge attached to a lower verge of the coil bobbin; and a magnetic circuit including a center pole, said center pole having a shoulder with an incised step, a top plate, said top plate having a shoulder with an incised step, a non-magnetic member and a magnet between the center pole and the top plate facing with each other through the non-magnetic member so that the step of the center pole and the step of the top plate face with each other through the non-magnetic member to form an L-shaped space channel at the mechanically abutting position, an air gap of the magnetic circuit where the voice coil is positioned being formed at a vertical leg of the L-shaped space channel, and the brim-like edge being fixed at a horizontal leg of the L-shaped space channel by a resilient packing member.

5. An electroacoustic converter comprising:

a diaphragm system including a dome-like diaphragm, a coil bobbin attached to a lower verge of the dome-like diaphragm, a voice coil wound around the coil bobbin and a brim-like edge attached to a lower verge of the coil bobbin;

a magnetic circuit including a center pole, a yoke, a magnet, a top plate and an air gap, said magnetic circuit having an L-shaped space channel between the center pole and the top plate, the voice coil of the diaphragm system being positioned within a vertical leg of the L-shaped space channel, and the brim-like edge of the diaphragm system being fixed to the magnetic circuit within a horizontal leg of the L-shaped space channel, and said center pole having a shoulder having a recessed step therein said top plate having a shoulder having a recessed step therein and the center pole and the top plate being mechanically abutted against each other such that the recessed step of the center pole and the recessed step of the top plate face with each other to form the L-shaped space channel.

6. An electroacoustic converter according to claim 5 further comprising a packing member which is inserted into the horizontal leg of the L-shaped space channel together with the brim-like edge so that the brim-like edge of the diaphragm system is fixedly pressed by the packing member.

7. An electroacoustic converter according to claim 6, wherein said packing member is resilient material.

8. An electroacoustic converter according to claim 6, wherein said packing member is in a taper-like shape.

9. An electroacoustic converter according to claim 5, wherein signal lead lines of the voice coil in said diaphragm system are taken from a lower side of the voice coil and extended along on the brim-like edge within the horizontal leg of the L-shape space channel.

10. An electroacoustic converter according to claim 9, wherein said top plate includes a guide channel through which the signal lead lines of the voice coil are drawn to the outside.

11. An electroacoustic converter according to claim 9 further comprising a packing member which is inserted into the horizontal leg of the L-shaped space channel together with the brim-like edge so that the signal lead lines of the voice coil are fixedly pressed by one packing member.

12. An electroacoustic converter according to claim 5, wherein the dome-like diaphragm, coil bobbin and brim-like edge are formed as an unit body out of the same material.

13. An electroacoustic converter comprising:

a diaphragm system including a dome-like diaphragm, a coil bobbin attached to a lower verge of the dome-like diaphragm, a voice coil wound around the coil bobbin and a brim-like edge attached to a lower verge of the coil bobbin; and a magnetic circuit including a center pole with an incised step at a shoulder thereof, a top plate having a shoulder with an incised step, and a magnet for producing magnetic flux in the magnetic circuit, the center pole and the top plate being mechanically abutted against each other so that the step of the center pole and the step of the top plate face with each other to form an L-shaped space channel at the mechanically abutting position, the L-shaped space channel having a vertical leg and a horizontal leg;

an air gap of the magnetic circuit being formed at the vertical leg of the L-shaped space channel, the voice coil being positioned at the vertical leg of the L-shaped space channel, and the brim-like edge being fixed at the horizontal leg of the L-shaped space channel by a resilient packing member.

14. An electroacoustic converter according to claim 13, wherein the step of the top plate has a sufficient depth such that the periphery of the brim-like edge of the diaphragm system mates with the vertical wall of the step of the top plate.

15. An electroacoustic converter according to claim 14, wherein two signal lead lines are taken from a lower side of the voice coil and extended along the brim-like edge so that the two signal lead lines are fixed by the resilient packing member within the horizontal leg of the L-shaped space channel.

16. An electroacoustic converter according to claim 13, wherein said center pole is partly incised under the step to increase the magnetic resistance at the a portion which abuts with the top plate.

* * * * *